US011040858B2

(12) United States Patent
Kulak et al.

(10) Patent No.: US 11,040,858 B2
(45) Date of Patent: Jun. 22, 2021

(54) ELEVATOR DOOR INTERLOCK ASSEMBLY

(71) Applicant: OTIS ELEVATOR COMPANY, Farmington, CT (US)

(72) Inventors: Richard E. Kulak, Niantic, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 416 days.

(21) Appl. No.: 15/967,855

(22) Filed: May 1, 2018

(65) Prior Publication Data

US 2019/0337768 A1 Nov. 7, 2019

(51) Int. Cl.
*B66B 13/20* (2006.01)
*B66B 13/12* (2006.01)

(52) U.S. Cl.
CPC ..... *B66B 13/20* (2013.01); *B66B 13/12* (2013.01)

(58) Field of Classification Search
CPC ..... B66B 13/12; B66B 13/18; B66B 13/20
See application file for complete search history.

(56) References Cited

U.S. PATENT DOCUMENTS

| | | | | |
|---|---|---|---|---|
| 1,950,150 | A | 3/1934 | Norton et al. | |
| 3,315,767 | A * | 4/1967 | George | B66B 13/12 187/280 |
| 3,638,762 | A | 2/1972 | Johns | |
| 4,094,385 | A | 6/1978 | Maeda et al. | |
| 4,457,405 | A | 7/1984 | Johns | |
| 4,923,055 | A | 5/1990 | Holland | |
| 5,538,106 | A | 7/1996 | McHugh et al. | |
| 5,651,427 | A | 7/1997 | Kulak et al. | |
| 5,651,428 | A | 7/1997 | Ahigian et al. | |
| 5,718,055 | A | 2/1998 | Pierce et al. | |
| 5,732,796 | A | 3/1998 | Ahigian et al. | |
| 5,959,266 | A | 9/1999 | Uchiumi | |
| 6,089,355 | A | 7/2000 | Seki et al. | |
| 6,173,813 | B1 | 1/2001 | Rebillard et al. | |
| 6,446,759 | B1 | 9/2002 | Kulak et al. | |

(Continued)

FOREIGN PATENT DOCUMENTS

| | | |
|---|---|---|
| CN | 201610675 U | 10/2010 |
| CN | 204057608 U | 12/2014 |

(Continued)

OTHER PUBLICATIONS

Extended European Search Report for Application No. EP 19 17 2084 dated Mar. 18, 2020.

(Continued)

*Primary Examiner* — Minh Truong
(74) *Attorney, Agent, or Firm* — Carlson, Gaskey & Olds

(57) ABSTRACT

An illustrative example elevator door interlock includes a latch situated for pivotal movement about a pivot axis between a door locking position and a released position. At least one coupling bumper is situated for movement with the latch between the door locking and released positions. The coupling bumper is selectively moved relative to the pivot axis into an alignment position where the coupling bumper is positioned to cooperate with a door coupler. At least one stationary support is situated to contact the coupling bumper when the latch is in the released position where the stationary support bears a load associated with moving an associated door.

7 Claims, 2 Drawing Sheets

(56) References Cited

U.S. PATENT DOCUMENTS

| | | | | |
|---|---|---|---|---|
| 6,474,448 | B1 | 11/2002 | Zappa | |
| 7,147,084 | B2 | 12/2006 | Jahkonen | |
| 7,252,179 | B2 | 8/2007 | Oberleitner | |
| 7,350,623 | B2 | 4/2008 | Kinoshita et al. | |
| 7,398,862 | B2 | 7/2008 | Dziwak | |
| 7,650,971 | B2 | 1/2010 | Pillin et al. | |
| 8,939,262 | B2 | 1/2015 | Schienda et al. | |
| 9,260,275 | B2 | 2/2016 | Reuter et al. | |
| 9,302,886 | B2 | 4/2016 | Tantis et al. | |
| 9,637,350 | B2 | 5/2017 | Mittermayr | |
| 9,656,835 | B2 | 5/2017 | Kitazawa | |
| 9,663,329 | B2 | 5/2017 | Zappa | |
| 9,834,413 | B2 | 12/2017 | Mittermayr | |
| 9,845,224 | B2 | 12/2017 | Rasanen et al. | |
| 10,196,237 | B2 | 2/2019 | Kattainen et al. | |
| 2001/0003319 | A1* | 6/2001 | Itoh | B66B 13/12 187/333 |
| 2012/0000729 | A1 | 1/2012 | Marvin et al. | |
| 2012/0000732 | A1 | 1/2012 | Draper et al. | |
| 2016/0145074 | A1 | 5/2016 | Kattainen et al. | |
| 2017/0190547 | A1 | 7/2017 | Dharmaraj | |
| 2018/0079621 | A1 | 3/2018 | Fauconnet et al. | |
| 2018/0118514 | A1 | 5/2018 | Bruno | |
| 2018/0229972 | A1 | 8/2018 | Kulak et al. | |
| 2018/0265334 | A1 | 9/2018 | Kulak et al. | |
| 2019/0337765 | A1 | 11/2019 | Wang et al. | |
| 2019/0337767 | A1 | 11/2019 | Tracey et al. | |
| 2019/0337768 | A1 | 11/2019 | Kulak et al. | |
| 2019/0337769 | A1 | 11/2019 | Khzouz et al. | |
| 2020/0115192 | A1 | 4/2020 | Montigny et al. | |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 2426076 | A1 | 3/2012 |
| EP | 3048075 | B1 | 3/2018 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

Extended European Search Report for Application No. EP 19 17 2026 dated Sep. 5, 2019.

Extended European Search Report for Application No. EP 19 17 2105 dated Sep. 27, 2019.

Extended European Search Report for Application No. EP 19 17 2040 dated Sep. 23, 2019.

The Extended European Search Report for EP Application No. 19172106.7, dated Jan. 31, 2020.

* cited by examiner

ELEVATOR DOOR INTERLOCK ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known coupler and interlock arrangements for coupling the elevator car doors to the hoistway doors so that the door mover that causes movement of the car doors also causes desired movement of the hoistway doors. Most door couplers include a set of vanes supported on the elevator car door structure. Most interlocks include at least one roller supported on the hoistway door structure. When the roller is received adjacent the vanes, it is possible to move both doors together. The movement of the car doors includes one of the vanes pushing on the roller to unlock the hoistway door and move it to open it with the elevator car door. This movement imposes a load on the latch of the interlock. In some cases, the same roller bears load associated with moving the hoistway door in the other direction.

It is believed that elevator door system components account for approximately 50% of elevator maintenance requests and 30% of callbacks. Almost half of the callbacks due to a door system malfunction are related to one of the interlock functions. One contributing factor to such issues is the wear and tear on the interlock latch and its associated components resulting from bearing the load associated with moving the hoistway door.

Another drawback associated with known interlock arrangements is that the process of installing the interlocks along the hoistway is time-consuming and undesirably complicated. Each interlock has to be positioned to receive the coupler vanes as the elevator car approaches the corresponding landing. Inaccurate interlock placement may result in undesired contact between the coupler vanes and the interlock as the elevator car passes the landing, for example. Additionally, adjusting the rollers to achieve the necessary alignment with the coupler requires adjusting the position of the corresponding hoistway door lock and switch to ensure that the interlock properly cooperates with the lock. If the lock and switch components are not accurately positioned, the elevator may not perform reliably as indications from the switches along the hoistway are needed to ensure that all hoistway doors are closed before the elevator car moves along the hoistway.

SUMMARY

An illustrative example elevator door interlock includes a latch situated for pivotal movement about a pivot axis between a door locking position and a released position. At least one coupling bumper situated for movement with the latch between the door locking and released positions. The coupling bumper is selectively movable relative to the pivot axis into an alignment position where the coupling bumper is positioned to cooperate with a door coupler. At least one stationary support is situated to contact the coupling bumper when the latch is in the released position where the stationary support bears a load associated with moving an associated door.

An example embodiment having one or more features of the elevator door interlock of the previous paragraph includes a first base. The at least one coupling bumper is supported on the first base and the first base is selectively movable relative to the pivot axis.

In an example embodiment having one or more features of the elevator door interlock of any of the previous paragraphs, the first base is selectively pivotally movable about the pivot axis.

An example embodiment having one or more features of the elevator door interlock of any of the previous paragraphs includes at least one fastener. The first base comprises a plate including at least one slot, the at least one fastener is at least partially received the at least one slot, and the at least one fastener selectively secures the first base in a selected position relative to the latch.

In an example embodiment having one or more features of the elevator door interlock of any of the previous paragraphs, the first base is selectively linearly movable relative to the pivot axis.

An example embodiment having one or more features of the elevator door interlock of any of the previous paragraphs includes a second base. The at least one stationary support is supported on the second base and the second base is selectively moveable relative to the pivot axis.

In an example embodiment having one or more features of the elevator door interlock of any of the previous paragraphs, the second base is selectively pivotally moveable about the pivot axis.

An example embodiment having one or more features of the elevator door interlock of any of the previous paragraphs includes at least one fastener. The second base includes at least one slot, the at least one fastener is at least partially received through the slot, and the at least one fastener selectively secures the second base and the stationary support in a fixed position relative to the pivot axis.

An example embodiment having one or more features of the elevator door interlock of any of the previous paragraphs includes a bracket, the bracket is selectively moveable relative to the latch, the coupling bumper is supported on the bracket, and the bracket is selectively secured to the latch to fix a position of the coupling bumper relative to the latch.

In an example embodiment having one or more features of the elevator door interlock of any of the previous paragraphs, the at least one coupling bumper comprises a roller and the stationary support comprises a roller.

An illustrative example method of installing an elevator door interlock includes positioning the latch in a selected position relative to a hoistway door component, adjusting a position of the at least one coupling bumper relative to the latch by moving a base supporting the at least one coupling bumper relative to the hoistway door component without moving the pivot axis of the latch, and securing the base in a selected position that secures at least the first one of the bumpers in a desired position relative to the hoistway door component when the latch is in a locking position.

In an example embodiment having one or more features of the method of the previous paragraphs, the elevator door interlock includes at least one stationary support and the method comprises adjusting a position of the stationary support relative to the pivot axis by moving a second base supporting the at least one stationary support relative to the hoistway door component, and securing the second base in a selected position that secures the at least one stationary support in a position to contact the at least one coupling bumper when the latch is in a released position.

In an example embodiment having one or more features of the method of any of the previous paragraphs, the at least one stationary support bears a load associated with moving an associated hoistway door.

In an example embodiment having one or more features of the method of any of the previous paragraphs, moving the base comprises pivoting the base about the pivot axis.

In an example embodiment having one or more features of the method of any of the previous paragraphs, moving the base comprises moving the base linearly relative to the pivot axis.

In an example embodiment having one or more features of the method of any of the previous paragraphs, the elevator door interlock includes a switch that indicates when the latch is in a locked position and the method comprises establishing a position of the switch relative to the pivot axis of the latch before adjusting the position of the at least one coupling bumper.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock that is easily adjustable for properly aligning the interlock with an elevator door coupler. The alignment can be achieved without requiring any adjustment of relative positions of the latch and lock switch components. Embodiments of this invention also avoid requiring a roller used to unlock the door lock to bear or carry a load associated with opening the hoistway door.

Figure 1:
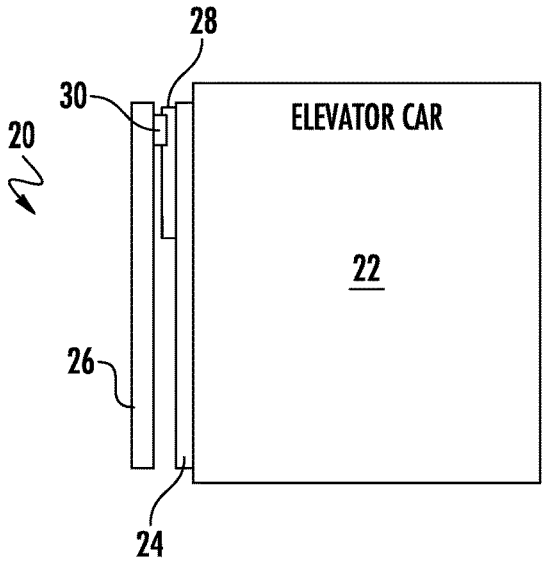
FIG. 1 schematically illustrates selected portions of an elevator system including a door interlock designed according to an embodiment of this invention.

FIG. 1 schematically illustrates selected portions of an elevator system 20. An elevator car 22 includes car doors 24 that are situated adjacent hoistway landing doors 26 when the elevator car 22 is parked at a landing. At least one portion or component of a door coupler 28 associated with the elevator car doors 24 cooperates with an interlock 30 associated with the hoistway doors 26 so that the elevator car doors 24 and the hoistway doors 26 move together between opened and closed positions.

Figure 2:
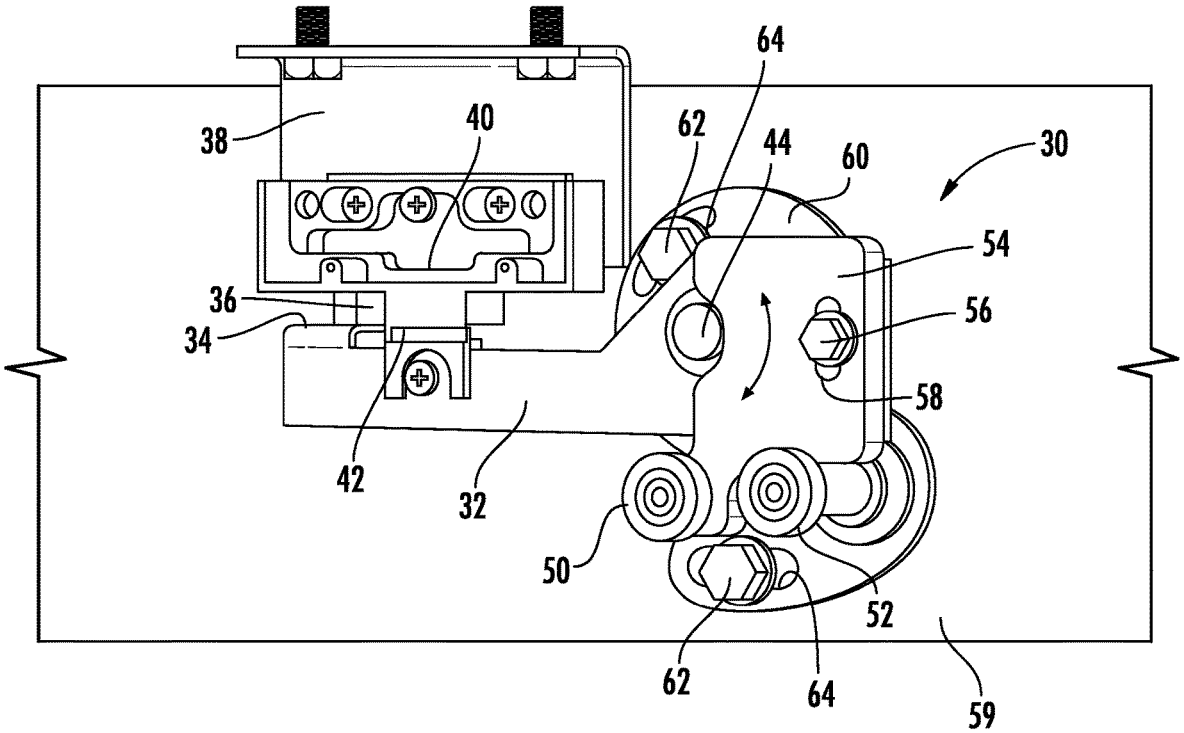
FIG. 2 is schematically shows an example elevator door interlock designed according to an embodiment of this invention with a latch in a locked position.
Figure 3:
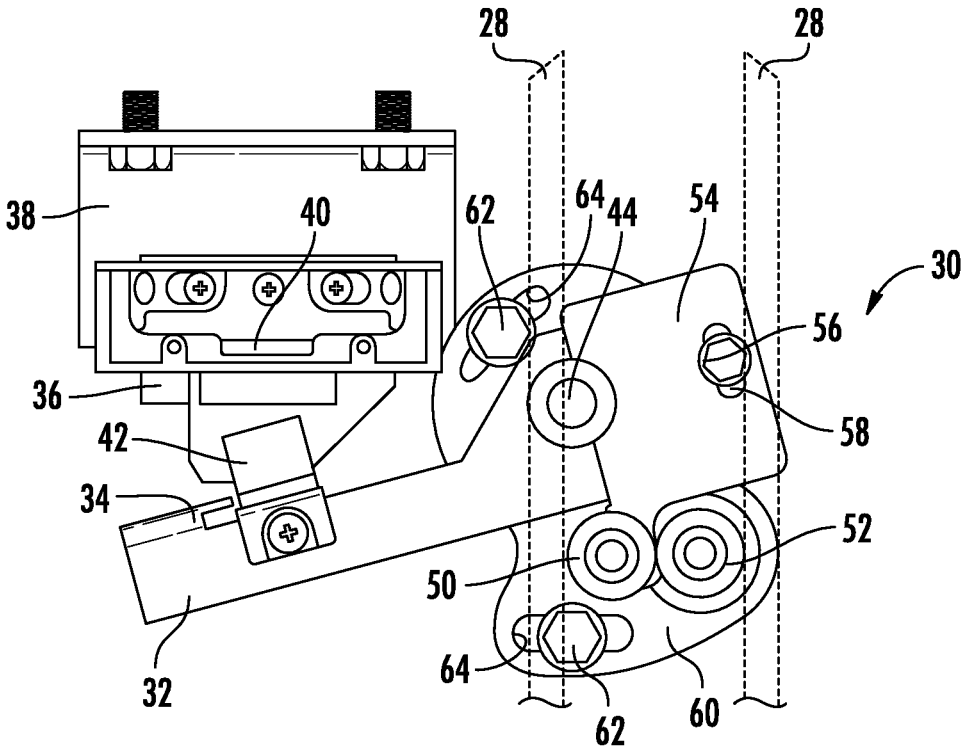
FIG. 3 shows the example interlock of FIG. 2 with the latch in a released position.

FIGS. 2 and 3 show the interlock 30 of an example embodiment. The interlock 30 includes a latch 32 that is moveable between a locking position (shown in FIG. 2) and a released position (shown in FIG. 3). A locking surface 34 on the latch 32 engages a stop 36 on a door lock 38 when the latch 32 is in the locking position. In the released position shown in FIG. 3, the locking surface 34 is clear of the stop 36 and the door 26 is free to move with the elevator car door 24.

The lock 38 includes a switch 40 that cooperates with a switch contact 42 supported on the latch 32 to provide an indication when the associated hoistway door 26 is closed and locked in a known manner. As the latch 32 rotates or pivots about a pivot axis 44, the switch contact 42 moves away from the switch 40 resulting in an indication from the switch 40 that the door 26 is unlocked.

As shown in FIG. 3, the door coupler 28 includes vanes that cooperate with at least one coupling bumper 50 to move the latch 32 from the locking position (of FIG. 2) into the released position. In the illustrated example, the door coupler 28 includes vanes that are received on opposite sides of the coupling bumper 50. Other coupler arrangements are used in other embodiments. As the coupler bumper 50 moves to the right (according to the drawings) the latch 32 rotates pivots about the pivot axis 44 until the coupling bumper contacts a stationary support 52. The coupling bumper 50 and the stationary support 52 comprise rollers in this example.

The coupling bumper 50 is supported on a first base 54 that is secured to the latch 32 by at least one fastener 56. A slot 58 allows for selective pivotal movement of the first base 54 about the pivot axis 44 to adjust a position of the coupling bumper 50 relative to the pivot axis and a door component 59, such as a door hanger associated with the hoistway door 26. Once the desired position of the coupling bumper 50 relative to the door coupler 28 is achieved, tightening the fastener 56 secures the first base 54 in the desired position relative to the latch 32.

The mass of the first base 54 also serves as a counterweight that biases the latch 32 into the locking position.

One feature of the example embodiment is that the pivot axis 44 of the latch 32 remains stationary relative to the door component 59 during the adjustment of the position of the coupling bumper 50. This allows for the coupling bumper 50 to be selectively aligned with the door coupler 28 without altering the relative alignment of the latch 32, lock 38, switch 40 and switch contact 42. Keeping all of those components in preselected position relative to the pivot axis 44 or the door component 59 avoids any potential misalignment of those components and reduces the complexity of and time required for aligning all interlocks 30 along a hoistway.

Once the coupling bumper 50 position is set, the stationary support 52 can be selectively positioned to achieve appropriate alignment with the door coupler 28 and a desired relationship between the position of the coupling bumper 50 and the stationary support 52. In this example embodiment, the stationary support 52 is supported on a second base 60 that is selectively moveable relative to the pivot axis 44. Fasteners 62 are at least partially received through slots 64 in the second base 60. When the fasteners 62 are loose enough the second base can be pivoted about the pivot axis 44 to adjust the position of the stationary support 52. Once the desired position is achieved, the fasteners 62 secure the second base in the desired position relative to the door component 59.

The stationary support 52 is situated to contact the coupling bumper 50 as the door coupler 28 causes movement of the coupling member to the right (according to the drawings) when the latch 32 is in a fully released position. The stationary support 52 serves the purpose of limiting an amount of latch movement and carrying loads associated with movement of the associated hoistway door 26. As the door coupler 28 causes continued movement to the right (according to the drawings) the door 26 moves in an opening direction. The load associated with moving the door 26 is born or carried by the stationary support 52 and transferred through the second base 60 to the door component 59. When the door coupler 28 moves the door 26 in an opposite direction to close the door (to the left in the drawings), the stationary support 52 is directly engaged by a vane of the coupler 28.

The example configuration of the coupling bumper 50 and stationary support 52 removes any strain on the latch 32 and its associated components as the coupling bumper 50 does not carry any of the load associated with moving the door 26. Reducing any such load on the coupling bumper 50 and the latch 32 increases the reliability and service life of the interlock 30.

Figure 4:
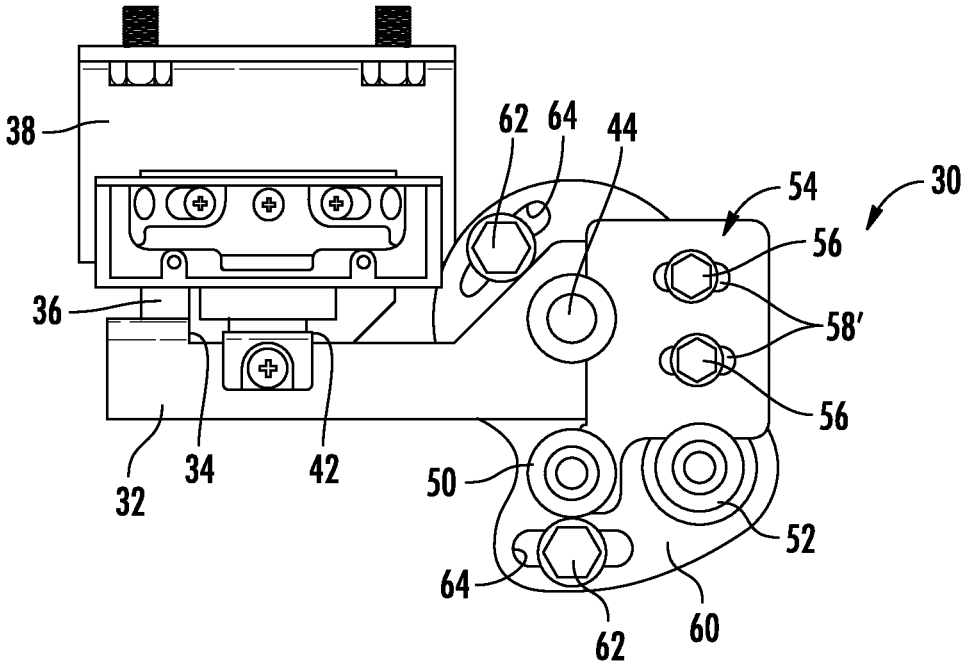
FIG. 4 shows another example elevator door interlock designed according to an embodiment of this invention.

FIG. 4 illustrates another example embodiment in which the first base 54' is linearly moveable relative to the pivot axis 44. In this example two fasteners 56 and slots 54' allow for selectively moving the base 54' and the coupling bumper 50 relative to the pivot axis to achieve alignment between the coupling bumper 50 and the door coupler 28 so that the interlock 30 works as intended.

Having the ability to adjust the position of the coupling bumper 50 and stationary support 52 without having to move any of the latch 32, pivot axis 44 or switch 40 allows for aligning interlocks 30 along an entire hoistway with the door coupler 28 of the elevator car 22 in a more efficient and economical manner There is no need to adjust the latch 32 or switch contact 42 relative to the lock 38 and switch 40, for example. There is no risk of a misalignment between the switch 40 and switch contact 42. This feature of the illustrated examples enhances the reliability of proper operation of the elevator system and reduces the amount of labor required to achieve proper alignment between the door coupler 28 and the interlocks 30 along the hoistway.

Additionally, the illustrated example embodiments allow for the position of the pivot axis 44, the lock 38, the switch 40, and the switch contact 42 to all be pre-established in a controlled manufacturing setting. The interlock 30 may be installed as a preassembled unit onto a door component 59, such as a door hanger, which further reduces labor, time and cost and further enhances the accuracy of the relative positions of the components of the interlock 30. This type of arrangement leads to a more reliable interlock system and elevator system operation.

Interlocks designed according to an embodiment of this invention facilitate reducing callbacks that are otherwise associated with problems or malfunctions caused by interlock misalignment or wear and tear on the latch and associated components of an interlock. Embodiments of this invention provide cost savings not only during installation or maintenance procedures, but also by reducing the need for maintenance or adjustment during the service life of the associated elevator system.

Different embodiments are shown and described but their respective features are not limited to just those embodiments. For example, at least one of the components of one embodiment may be used in place of a corresponding component of another embodiment. Additional embodiments can be realized by combining various features of the disclosed examples.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door interlock, comprising:

a latch situated for pivotal movement about a pivot axis between a door locking position and a released position;

at least one coupling bumper situated for movement with the latch between the door locking and released positions, the coupling bumper is selectively moved relative to the pivot axis into an alignment position where the coupling bumper is positioned to cooperate with a door coupler;

at least one stationary support situated to contact the coupling bumper when the latch is in the released position where the stationary support bears a load associated with moving an associated door; and a first base, wherein the at least one coupling bumper is supported on the first base, the first base is selectively movable relative to the pivot axis, and the first base is selectively pivotally movable about the pivot axis.

2. The elevator door interlock of claim 1, comprising at least one fastener and wherein the first base comprises a plate including at least one slot;

the at least one fastener is at least partially received the at least one slot; and the at least one fastener selectively secures the first base in a selected position relative to the latch.

3. The elevator door interlock of claim 1, comprising a second base and wherein the at least one stationary support is supported on the second base; and the second base is selectively moveable relative to the pivot axis.

4. The elevator door interlock of claim 1, wherein the at least one coupling bumper comprises a roller; and the stationary support comprises a roller.

5. An elevator door interlock, comprising:

a latch situated for pivotal movement about a pivot axis between a door locking position and a released position;

at least one coupling bumper situated for movement with the latch between the door locking and released positions, the coupling bumper is selectively moved relative to the pivot axis into an alignment position where the coupling bumper is positioned to cooperate with a door coupler;

at least one stationary support situated to contact the coupling bumper when the latch is in the released position where the stationary support bears a load associated with moving an associated door;

a first base; and a second base, wherein the at least one stationary support is supported on the second base, the at least one coupling bumper is supported on the first base, the first base is selectively movable relative to the pivot axis, and the second base is selectively pivotally moveable about the pivot axis.

6. The elevator door interlock of claim 5, comprising at least one fastener and wherein the second base includes at least one slot;

the at least one fastener is at least partially received through the slot; and the at least one fastener selectively secures the second base and the stationary support in a fixed position relative to the pivot axis.

7. An elevator door interlock, comprising:

a latch situated for pivotal movement about a pivot axis between a door locking position and a released position;

at least one coupling bumper situated for movement with the latch between the door locking and released positions, the coupling bumper is selectively moved relative to the pivot axis into an alignment position where the coupling bumper is positioned to cooperate with a door coupler;

at least one stationary support situated to contact the coupling bumper when the latch is in the released position where the stationary support bears a load associated with moving an associated door; and a bracket and wherein the bracket is selectively moveable relative to the latch;

the coupling bumper is supported on the bracket; and the bracket is selectively secured to the latch to fix a position of the coupling bumper relative to the latch.

* * * * *